United States Patent [19]

Dahle

[11] 4,040,556

[45] Aug. 9, 1977

[54] HAND-OPERATED STAPLER

[75] Inventor: Gerald Dahle, Coburg, Germany

[73] Assignee: Wilhelm Dahle Buro- und Zeichengeratefabrik, Coburg, Germany

[21] Appl. No.: 707,704

[22] Filed: July 22, 1976

[30] Foreign Application Priority Data

July 31, 1975 Germany ..... 2534178

[51] Int. Cl.[2] ..... B25C 5/02

[52] U.S. Cl. ..... 227/120

[58] Field of Search ..... 227/120, 125, 126, 127, 227/128

[56] References Cited

U.S. PATENT DOCUMENTS

| | | | |
|---|---|---|---|
| 1,507,775 | 9/1924 | Hoehn | 227/138 |
| 2,399,761 | 5/1946 | Ruskin | 227/128 |
| 2,939,146 | 6/1960 | Abrams | 227/120 |
| 3,640,443 | 2/1972 | Itagaki | 227/120 |

*Primary Examiner*—Granville Y. Custer, Jr.
*Attorney, Agent, or Firm*—Spencer & Kaye

[57] ABSTRACT

In a stapler composed of three parts constituting, respectively, a base plate carrying a staple leg bending anvil, a staple magazine for holding a strip of staples, and an actuating lever carrying a staple driver disposed to drive successive staples toward the anvil, the staple magazine is connected to the base plate by a first pivot connection and to the actuating lever by a second pivot connection, each connection is composed of a pin carried by one part and a recess formed in the other part, the parts are elastically deformable in the region of the connections to permit each pin to be snapped into its associated recess, and the staple magazine and base plate are provided with guide surfaces to limit movement therebetween to a direction perpendicular to the pivot axis of the first pivot connection.

12 Claims, 5 Drawing Figures

HAND-OPERATED STAPLER

BACKGROUND OF THE INVENTION

The present invention relates to a hand-operated, portable stapler, particularly for office use.

Staplers of this type generally include a base plate provided at its free end with an anvil for bending the staple legs, a staple magazine pivotally connected to the other end of the base plate to be pivotal in a plane perpendicular to the base plate, and an actuating lever pivotally connected by means of a separate bearing to the staple magazine to also be pivotal in a plane perpendicular to the base plate to actuate a staple driver to drive the staples from the staple magazine. The stapler is in addition provided with lateral guide surfaces disposed between the base plate and the staple magazine or between the staple magazine and the actuating lever. One such structure is disclosed in British Pat. No. 619,300.

In the stapler of the above-mentioned type, the three main components i.e. base plate, staple magazine and actuating lever, are each made of a metallic material. These three main parts are connected together in pairs by separate, riveted pivot members defining pivot axes. Guide surfaces are provided between the staple magazine and the base plate in the form of longitudinal ribs which protrude upwardly from the base plate into the pivoting range of the staple magazine, with the sides of the ribs resting against the staple magazine. These longitudinal ribs create inconvenience if the stapler is to be used as a staple "gun", i.e. if the base plate is pivoted by about 180° or more out of the operating position and thus is made ineffective, to drive staples into a thick substrate, for example to attach sheets of paper to walls or to wooden supports.

It is also known to releasably connect the staple magazine of a stapler to the base plate of the stapler by a catch joint connection, as disclosed in U.S. Pat. Nos. 1,507,775 and 1,740,322, and to fabricate the actuating lever of a stapler of the above-mentioned type as an injection-molded plastic unit, as disclosed in British Pat. No. 967,415.

SUMMARY OF THE INVENTION

It is an object of the present invention to substantially simplify the structure of the main parts of a stapler of the above-mentioned type, i.e the base plate, the staple magazine and the actuating lever, as well as their bearings and the guides, between these parts, without reducing its operating capabilities.

These and other objects of the invention are achieved by constituting the pivot connection between the staple magazine and each of the base plate and actuating lever by a pivot pin carried by one of the parts to be connected and a recess formed in the other part to be connected, by making at least one of these parts elastically deformable in the region of an associate connection to permit the pivot pin to be inserted into its respective recess by elastic deformation of at least one of the parts associated with the connection, by providing the base plate with a recess which opens toward the staple magazine and is defined by side walls which extend longitudinally of the base plate and which are directed toward the staple magazine, the side walls presenting surfaces which face one another to define longitudinal boundaries of the recess and to define first lateral guide surfaces, and by forming the staple magazine to present second lateral guide surfaces which are guided by the first guide surfaces.

The present invention first of all eliminates special connection axes between the three main stapler parts. The parts required to form pivot connections, i.e. the pins and the recesses to accommodate the pins, may each be made integral with the respective parts, which is particularly favorable for mass production of these parts by the injection molding of plastic.

The configuration of the guide surface at the staple magazine with respect to the base plate further enhances use of the stapler as a staple "gun", i.e. in an operating position in which the base plate has been pivoted backwardly by 180° or more away from the region where it underlies the staple magazine, for driving staples into thick substrates.

Furthermore, the arrangement, according to the present invention, of the guide surfaces between the staple magazine and the base plate substantially avoids the danger of pinching the operator's hand, particularly if the stapler is used in the palm of the hand without being rested on a table. Moreover, this arrangement of the guide surfaces does not entail an increase in the width of the stapler, as is the case, for example, for the guide surface configuration disclosed in German Auslegeschrift [Published Application] No. 1,051,801.

According to a further feature of the invention, the longitudinal side walls are connected together at their ends by transverse ribs which serve to reinforce the longitudinal ribs.

In further accordance with the invention, the recess in the base plate is used to house a spring which acts to urge the staple magazine away from the base plate to bring the staple magazine into the normal open position of the stapler.

DESCRIPTION OF THE PREFERRED EMBODIMENTS

Figure 1:
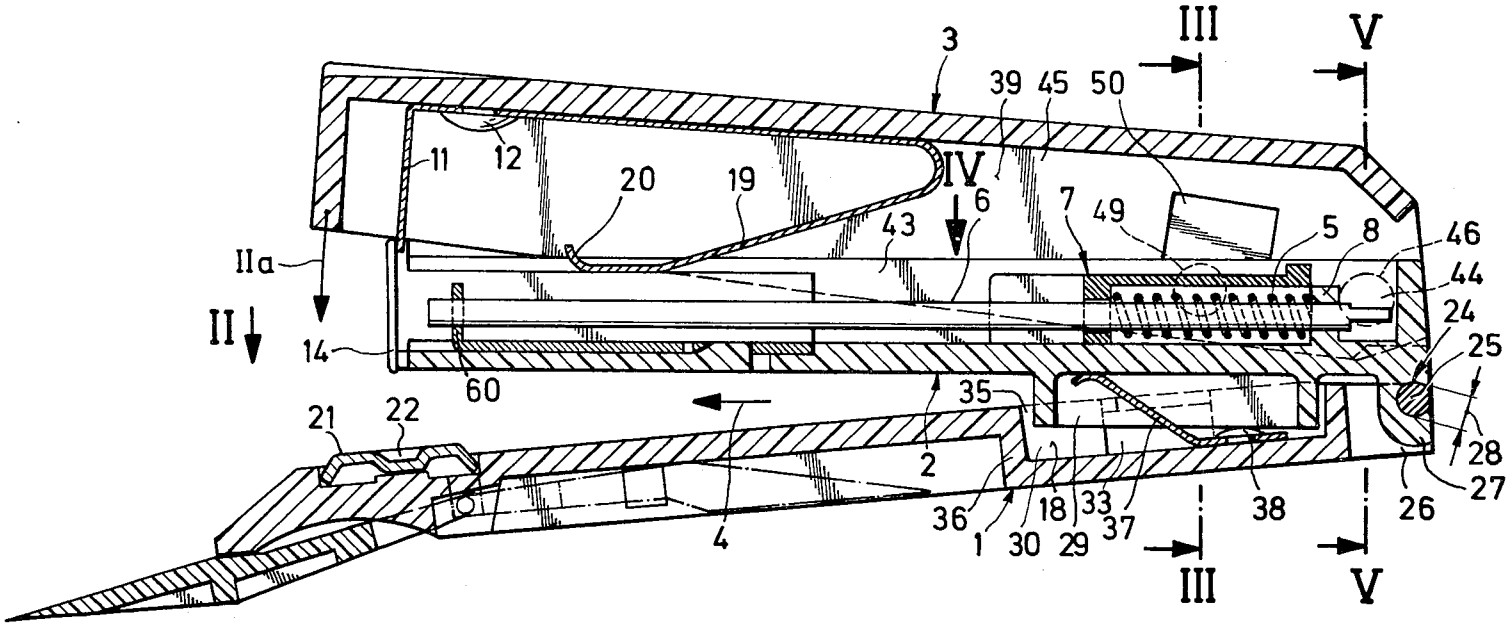
FIG. 1 is a side elevational cross-sectional view of one preferred embodiment of a stapler according to the invention.

The stapler shown in FIG. 1 essentially includes three parts: the base plate 1; the staple magazine 2; and the actuating lever 3. The staple magazine 2 operates in a manner corresponding to that of known staple magazines. A strip of staples (not shown) is disposed within staple magazine 2 to be longitudinally movable in the direction of arrow 4.

Figure 4:
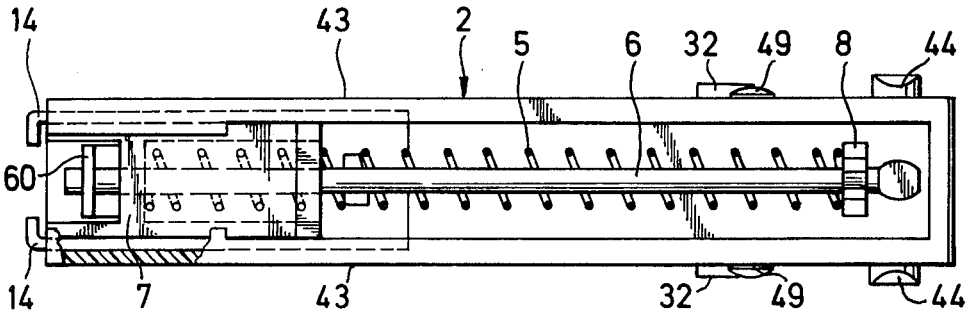
FIG. 4 is a top plan view of the staple magazine of FIG. 1, taken in the direction of arrow II in FIG. 1.

The magazine 2 is provided with a compression spring 5 arranged to urge the staple strip in the directon of arrow 4, spring 5 being shown in its compressed state in FIG. 1 and in its expanded state in FIG. 4. Compression spring 5 is placed around a guide rod 6 which is fastened within magazine part 2 to extend in the longitudinal direction 4. Also mounted on guide rod 6 is a pusher 7, provided with an opening through which rod 6 passes. Around this opening, pusher 7 presents an abutment surface against which bears the end of spring 5 which faces in the direction of advance 4. The opposite, or rear, end of compression spring 5 is supported at a supporting flange 8 which is firmly connected to staple magazine 2 and which also forms a support for guide rod 6. The front end of rod 6 is supported by an angle piece 60 having an opening which receives the rod. The end of pusher 7 facing in the direction of advance 4 bears against the hindmost staple of a staple strip and thus presses the staple strip within the guide section of magazine 2 in the direction 4, toward the front discharge end of the latter.

The actuating lever 3 has a standard, generally box-shaped configuration and is also made of plastic. In the interior of this box, a staple driver 11 is fastened by a rivet 12 to protrude downwardly in a direction approximately perpendicular to the length of lever 3. In order to expel the foremost staple of a staple strip, the staple driver 11 enters between two parallel guide rails 14, shown in FIGS. 1 and 4, which are fastened to the front end of the magazine part and extend perpendicularly to the length thereof.

Staple driver 11 is constituted by the end of a bar of spring steel whose center portion extends longitudinally along the underside of actuating lever 3 and whose other free end 19 is bent in a downward direction and toward the front end of staple magazine 2 and presents a generally longitudinally extending terminal portion 20.

When actuating lever 3 is depressed in the direction of arrow II, terminal portion 20 comes to bear against either the staple strip or pusher 7 in staple magazine 2. Upon completion of a stapling operation, the leaf spring constituted by end 19 and terminal portion 20 serves to lift actuating lever 3 away from magazine 2, thereby moving staple driver 11 upwardly so that pusher 7 can again exert a pushing action against the strip of staples.

Base plate 1 is provided at its front end with an anvil 21 for bending the staple legs, the anvil being formed in a known manner to present two anvil grooves 22 in which the free ends of the legs of a staple passing through the material to be stapled are either spread apart or brought together, in a known manner.

A special pivot connection 24 is provided between staple magazine 2 and base plate 1. The longitudinal axis of this pivot connection extends in a known manner perpendicular to the plane of the drawing in FIG. 1. Pivot connection 24 has the form of a plug-in hinge. The axis of this hinge lies just below the plane of the upper surface of base plate 1 and is thus approximately in the plane of the base plate. The pivot connection includes a hinge pin 25 which is injection molded in one piece with base plate 1, as appears in FIG. 2. Pin 25 forms the rear end of plate 1 and is there fixed between two integrally formed holding jaws 26 which extend over the entire height of base plate 1 as may be seen in FIG. 5. Jaws 26 present mutually parallel planar inner surfaces 23, shown in FIG. 2.

The rear end of staple magazine 2 is provided with a gripping claw 27 which protrudes below the lower surface of staple magazine 2 in a downward direction and with its lower end directed toward the rear. Gripping claw 27 presents a rearwardly open bearing cup into which pin 25 is inserted to assemble base plate 1 and magazine 2 together, in the configuration shown in FIG. 1. The lateral end surfaces of gripping claw 27 then rest flush against the inner surfaces 23 of holding jaws 26. Gripping claw 27 thus extends over the entire length of hinge pin 25. The enclosure angle of gripping claw 27, i.e. that of the bearing cup formed thereby, with respect to the periphery of hinge pin 25 is greater than 180°. This means that the width 28 of the aperture slit in the bearing cup is at least slightly less than the diameter of the hinge pin.

Figure 3:
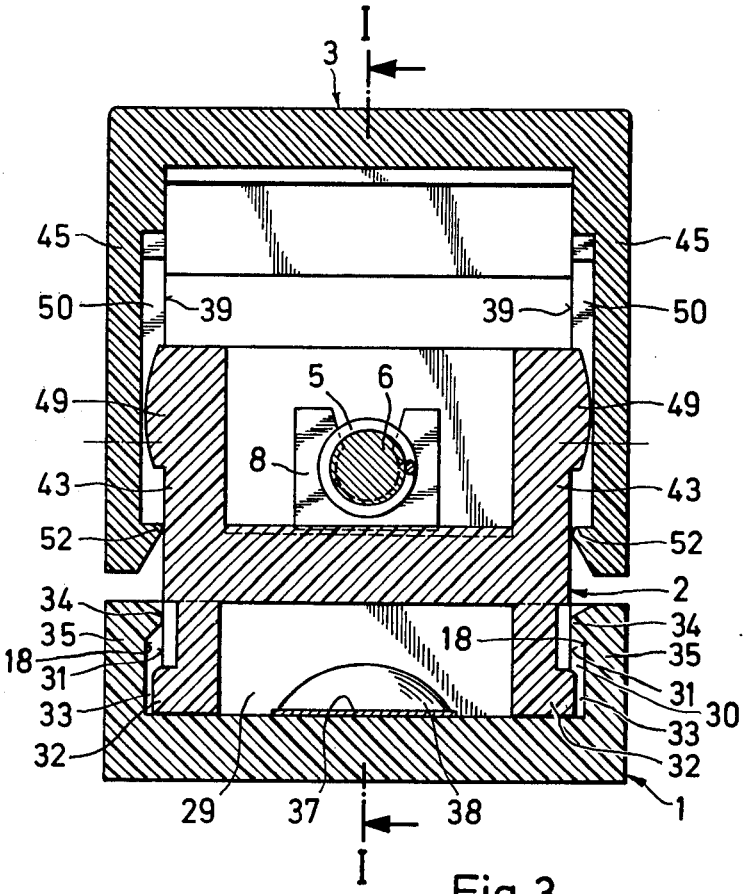
FIG. 3 is a cross-sectional view taken along the line III—III of FIG. 1.

As can be seen in FIGS. 1 and 3, the underside of magazine 2 is provided with a downwardly extending and downwardly open box-like structure 29 near gripping claw 27, which structure projects into a corresponding recess 30 formed in the upper surface of base plate 1 and moves further into that recess when the staple magazine 2 is moved in the direction of arrow II upon depression of lever 3. The outer lateral surfaces 31 of this box-like structure 29, which are parallel to the longitudinal sides of the stapler, and the inner lateral surfaces 18 of recess 30 which are planar and parallel to surfaces 30, are in contact with one another and act as guide members which keep the pivoting movement in an accurate pivot plane and prevent the staple magazine 2 from being deflected in a direction perpendicular to the plane of FIG. 1.

As appears in FIG. 3, the outer surfaces 31 of structure 29 are provided with outwardly protruding detent or slide ribs 32 which extend along a limited portion of the length of surfaces 31 and which act as guide members. When the staple magazine 2 is approximately in the open position with respect to base plate 1, as shown in FIG. 1, these guide members 32 rest in cutouts 33 (FIGS. 2 and 3) formed in the inner surfaces 18 of recess 30. Cutouts 33 define ribs 34 on the inner surfaces 18 of recess 30. Ribs 34 normally project inwardly beyond ribs 32 to establish the normal raised position of magazine 2 relative to base 1, shown in FIG. 1. The upper edges of ribs 34 are inclined, as shown in FIG. 3, to form camming surfaces which cooperate with the lower edges or ribs 32 to permit structure 29 to enter recess 30 during assembly of parts 1 and 2 or when base plate 1 is returned to the position shown in FIG. 1 after having been pivoted out of the way to enable the stapler to operate as a staple gun.

Figure 2:
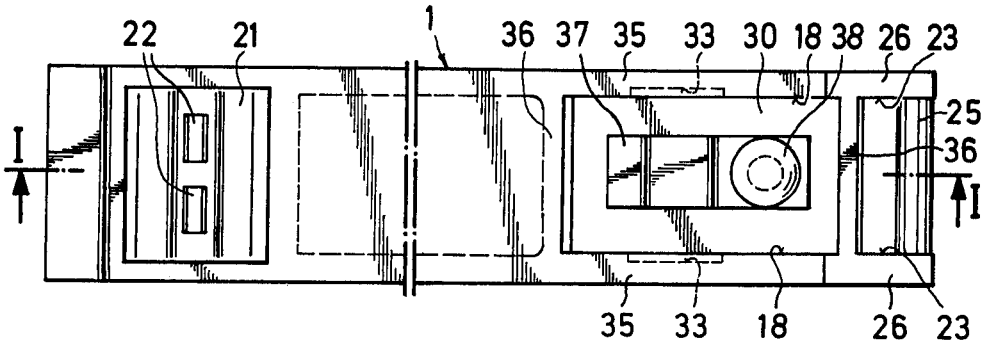
FIG. 2 is a top plan view of the main parts of the base plate of FIG. 1, taken in the direction of arrow II of FIG. 1.

The longitudinal edges of the box-like structure 29 form upwardly extending longitudinal side walls 35 which are connected together, or reinforced, by transverse ribs 36, as shown in FIG. 2.

A compression spring in the form of a leaf spring 37 is fastened by means of a rivet 38 to the bottom of recess 30 so that its free end extends upwardly and rests against the bottom of the box-like structure 29 to press the staple magazine 2 into substantially the open position shown in FIG. 1 if actuating lever 3 is not being actuated. In this open position the slide ribs 32 of staple magazine 2 rest laterally against ribs 34 of base plate 1. The spring force exerted by leaf spring 37 is not sufficient to overcome the restraining force of ribs 34 on slide ribs 32 so that greater opening angle than that shown in FIG. 1 between base plate 1 and staple magazine 2 can be achieved only by applying an added separation force between those parts.

If, for example, in order to permit the stapler to act as a gun for driving staples into thick bodies, the staple magazine 2 is to be brought into a position in which it forms an angle of more than 90° with base plate 1, the operator must exert finger pressure beyond the force of leaf spring 37 to cause slide ribs 32 to pass over ribs 34 in the manner of a cam. This assures that durng normal operation of the stapler the angular position between base plate 1 and staple magazine 2 will not go beyond the angular position shown in FIG. 1, which substantially simplifies operation of the stapler.

Figure 5:
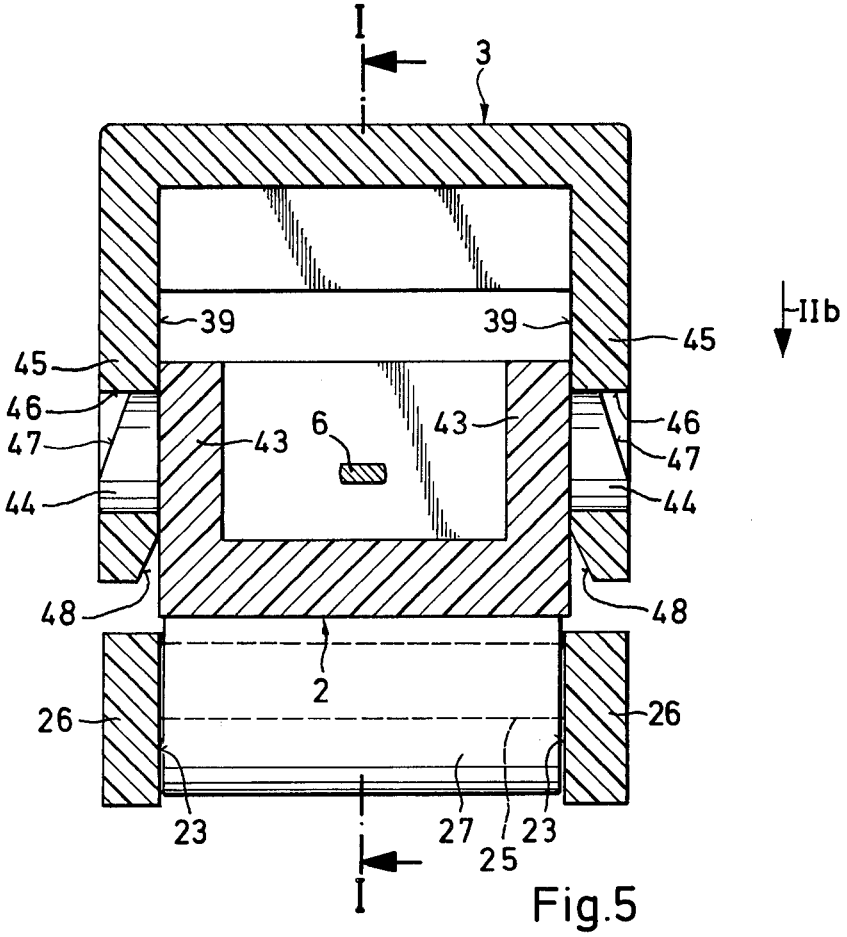
FIG. 5 is a cross-sectional view taken along the line V—V of FIG. 1.

Referring now specifically to FIGS. 4 and 5, pins 44 protrude from the side walls 43 at the rear end of staple magazine 2 and form a one-piece unit with those side walls. Pins 44 constitute pivot pins which, when the stapler is assembled, engage in bearing holes 46 formed in the side walls 45 of actuating lever 3 covering staple magazine 2. The outer end faces 47 of pins 44 and the lower edges 48 of the inner surfaces of side walls 45 are slanted outwardly and downwardly, in the push-on direction II. This greatly facilitates pushing of actuating lever 3 onto staple magazine 2 during assembly of the stapler, when surfaces 47 and 48 will slide along one another and execute a camming action.

Furthermore, as shown in FIGS. 3 and 4, detent knobs 49 are provided on the outer surface of side walls 43 of staple magazine 2, near the upper edge thereof, to protrude therefrom. In the normal covering position of actuating lever 3 with respect to staple magazine 2, detent knobs 49 rest in cutouts 50 formed in the inside surfaces 39 of side walls 45 of actuating lever 3. These cutouts 50 are of limited longitudinal extent and define cam-like raised portions 52 in the region of the lower edges of side walls 45 which when actuating lever 3 and staple magazine 2 are being assembled slide over the detent knobs 49.

Once units 2 and 3 have been assembled, detent knobs 49 cooperate with raised portions 52 to keep actuating lever 3 from pivoting away from staple magazine 2 beyond the normal rest position shown in FIG. 1. The force applied by opening spring 19 is given a value which is sufficiently low to assure that knobs 49 can normally not pass raised portions 52. Only by the application of an additional separating force by the operator can staple magazine 2 and actuating lever 3 be pivoted further apart in order to insert a new strip of staples into staple magazine 2.

In order to assemble the stapler, base plate 1, staple magazine 2 and actuating lever 3 are individually provided with their appropriate accessories and these parts are then assembled together by placing actuating lever 3 onto pins 44 of staple magazine 2 and pushing staple magazine 2 onto hinge axis 25 of base plate 1. This completes assembly of the stapler.

To perform a stapling operation, actuating lever 3 is depressed in the direction of arrow II, causing staple magazine 2 to be pivoted in the direction toward the material which is to be stapled and which is disposed between staple magazine 2 and base plate 1. By reason of the substantial penetration of box-shaped structure 29 into recess 30 on the surface of base plate 1, and because of the guidance active over the entire length of axis 25 as well in the region of holding jaws 26, the staple magazine is optimally secured against lateral displacement from the intended pivot plane with respect to base plate 1. This intended pivot plane is identical with the plane of FIG. 1.

Inasmuch as the present invention relates to details in the design of different bearings and guide members, the same can also advantageously be used alone without functionally dependent members.

It will be understood that the above description of the present invention is susceptible to various modifications, changes and adaptations, and the same are intended to be comprehended within the meaning and range of equivalents of the appended claims.

What is claimed is:

1. In a hand operated, portable stapler composed of a first part constituting a base plate having an anvil at one end for bending staple legs, a second part constituting a staple magazine for holding a strip of staples and bringing each staple in succession into an ejection position at one end of the magazine, a third part constituting an actuating lever carrying a staple driver aligned with the ejection position, first connecting means pivotaly connecting the other end of the first part to the second part to permit the second part to pivot toward and away from the first part, second connecting means pivotally connecting the third part to the second part to permit the third part to pivot toward and away from the second part to enable the staple driver to drive successive staples in the ejection position, the first and second connecting means presenting parallel pivot axes, and at least one of the parts being provided with lateral guide surfaces to confine the pivotal movement of that part and a part connected thereto to the direction defined by the pivot axes, the improvement wherein:

each said connecting means comprises at least one pivot pin carried by one of said parts which it connects and the other of said parts which it connects is provided with at least one recess for each said pin, and at least one of said parts associated with each said connecting means is elastically deformable in the region of said connecting means for permitting said pin to be inserted into its respective recess by elastic deformation of at least one of said parts associated with said connecting means; and said base plate is provided with a recess which opens toward said staple magazine and is defined by side walls which extend longitudinally of said base plate and which are directed toward said staple magazine, said side walls presenting surfaces which face one another to define longitudinal boundaries of said recess and to define first ones of said lateral guide surfaces, and said staple magazine presents second ones of said lateral guide surfaces which are guided by said first ones of said guide surfaces.

2. An arrangement as defined in claim 1 wherein said base plate further comprises transverse ribs connecting said longitudinally extending side walls together at their ends for reinforcing said longitudinally extending side walls, said transverse ribs defining the longitudinal boundaries of said recess in said base plate.

3. An arrangement as defined in claim 2 further comprising a spring member enclosed between said first and second parts and disposed in said recess in said base plate to exert a force between said base plate and said staple magazine to urge them apart.

4. An arrangement as defined in claim 1 wherein said base plate is movable, relative to said staple magazine, between a rearwardly directed end position in which said anvil is removed from the vicinity of said staple magazine ejection position, a normal operating position in which said anvil is generally aligned with, and spaced from, said staple magazine ejection position, and a staple driving position in which said stapling magazine is pressed against said anvil, said surfaces of said side walls which face one another are provided with detent members which project toward one another, said staple magazine presents slide ribs arranged to cooperate with said detent members in a manner to be forced over said detent members in a cam-like manner when said base plate is brought from its rearwardly directed end position to said normal operating position and said slide ribs and detent members are formed to abut against one another to define said normal operating position when said base plate moves away from its staple driving position.

5. An arrangement as defined in claim 1 wherein each of said first, second and third parts is made of plastic having said pins and recesses of said connecting means formed integrally therewith.

6. An arrangement as defined in claim 1 wherein said staple magazine is provided, at the end thereof remote from the ejection position end, with a downwardly extending gripping claw having a cylindrical recess which constitutes the recess of said first connecting means and which is open along its length at the surface of said claw which is directed away from said ejection position, and said pin of said first connecting means is fixed to said base plate and engages in said cylindrical recess.

7. An arrangement as defined in claim 6 wherein the width of the open portion of said cylindrical recess is normally slightly less than the diameter of said pin of said first connecting means.

8. An arrangement as defined in claim 6 wherein said gripping claw is substantially coextensive, in the axial direction, with said pin of said first connecting means.

9. An arrangement as defined in claim 8 wherein said base plate is provided with holding jaws disposed along respective lateral sides thereof and presenting mutually parallel planar inner surfaces, said jaws being located at said other end of said base plate and being fixed to the axial extremities of said pin of said first connecting means, and the lateral surfaces of said gripping claw are in flush contact with said inner surfaces of said holding jaws.

10. An arrangement as defined in claim 1 wherein said staple magazine is provided, at the end thereof remote from said ejection position, with integrally formed, laterally outwardly projecting pins constituting pins of said second connecting means, and said actuating lever includes side walls provided with openings constituting recesses of said second connecting means, each said projecting pin engaging in a respective opening.

11. An arrangement as defined in claim 10 wherein the outer end face of each said projecting pin is inclined inwardly in the direction toward said actuating lever and the inner surfaces of said actuating lever side walls, at the lower edges of said actuating lever side walls and in the regions below said openings, are inclined outwardly toward said staple magazine to enable said actuating lever side walls to slide over the end faces of said projecting pins during insertion of said projecting pins into said openings.

12. An arrangement as defined in claim 10 wherein said staple magazine is provided with laterally outwardly extending detent projections and said actuating lever is provided, at the inner surfaces of its side walls, with laterally inwardly extending latching projections formed and disposed to cooperate with said detent projections in a manner to permit said detent projections to move past said latching projections when said actuating lever is moved toward said staple magazine while normally preventing said actuating lever from being subsequently separated from said staple magazine.

* * * * *